United States Patent [19]

Nishikawa

[11] 4,401,410

[45] Aug. 30, 1983

[54] DIAGONAL-FLOW FAN WHEEL WITH BLADES OF DEVELOPABLE SURFACE SHAPE

[75] Inventor: Yoshiyasu Nishikawa, Ono, Japan

[73] Assignee: Kawasaki Jukogyo Kabushiki Kaisha, Kobe, Japan

[21] Appl. No.: 214,290

[22] Filed: Dec. 8, 1980

Related U.S. Application Data

[62] Division of Ser. No. 918,556, Jun. 23, 1978, Pat. No. 4,274,810.

[30] Foreign Application Priority Data

Jun. 29, 1977 [JP] Japan ..... 52-78168
Jul. 1, 1977 [JP] Japan ..... 52-79309

[51] Int. Cl.[3] ..... F04D 29/28
[52] U.S. Cl. ..... 416/186 R; 416/242
[58] Field of Search ..... 416/186, 186 R, 242, 416/182, 185

[56] References Cited

U.S. PATENT DOCUMENTS 1,341,882 6/1920 Criqui ..... 416/242 X

FOREIGN PATENT DOCUMENTS 563373 12/1957 Belgium ..... 416/186
2135943 2/1973 Fed. Rep. of Germany ..... 416/185
1328082 8/1973 United Kingdom ..... 415/185
590489 1/1978 U.S.S.R. ..... 416/186 R

*Primary Examiner*—Harvey C. Hornsby
*Assistant Examiner*—Shewen Bian
*Attorney, Agent, or Firm*—Martin Smolowitz

[57] ABSTRACT

A blade of the fan wheel of a diagonal-flow fan, which blade should ideally have a shape of a twisted double-curvature or undevelopable surface, is formed from a portion of a combination of a cylindrical plate and a planar plate tangent to the cylindrical plate or of a combination of a pair of mutually circumscribing cylindrical surfaces, which portion constitutes a developable surface. To realize the formation of a blade from the developable surface, lines of intersection between combined cylinder and planar plates or combined cylinders and a number of coaxial imaginary conical surfaces representing streamlines in the fan wheel are used as a basis for design.

2 Claims, 26 Drawing Figures

FIG. 7A
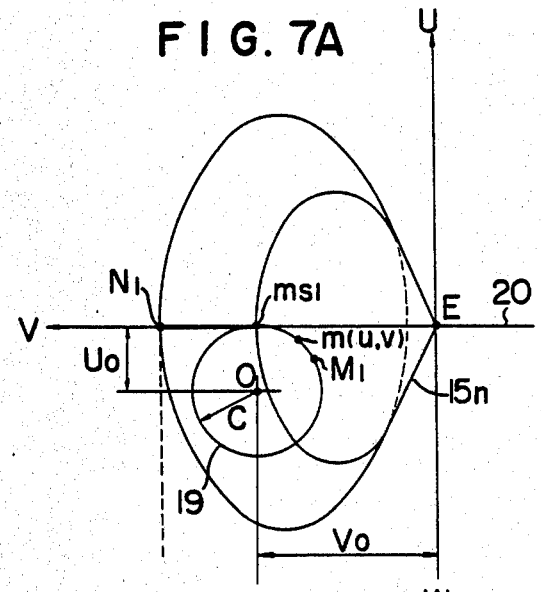
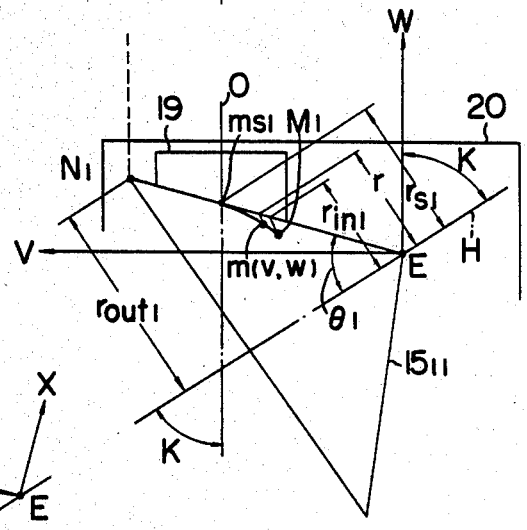
FIG. 7B
FIG. 7C
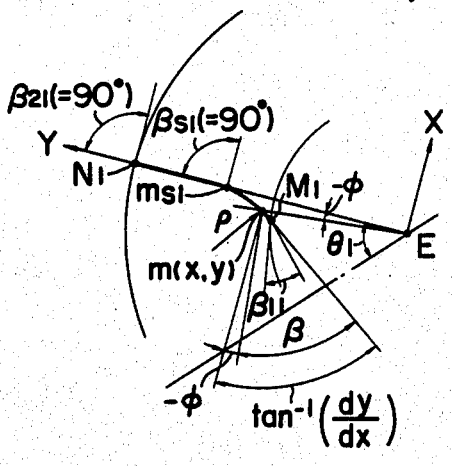

FIG. 10A
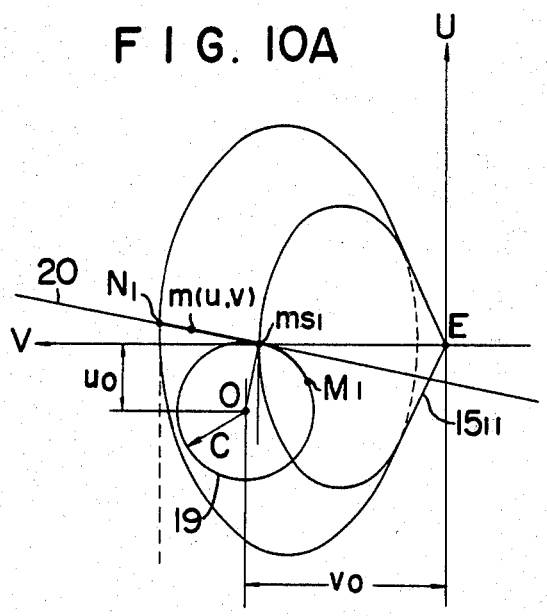
FIG. 10C
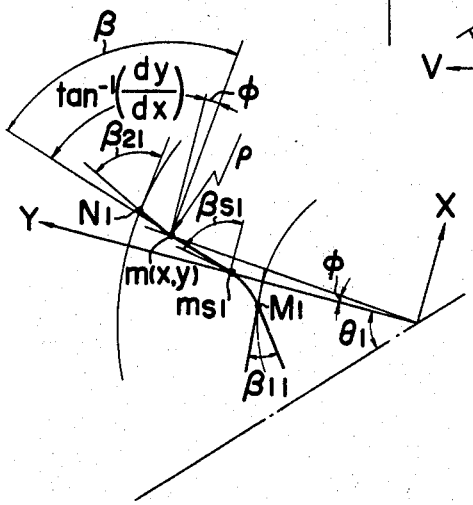
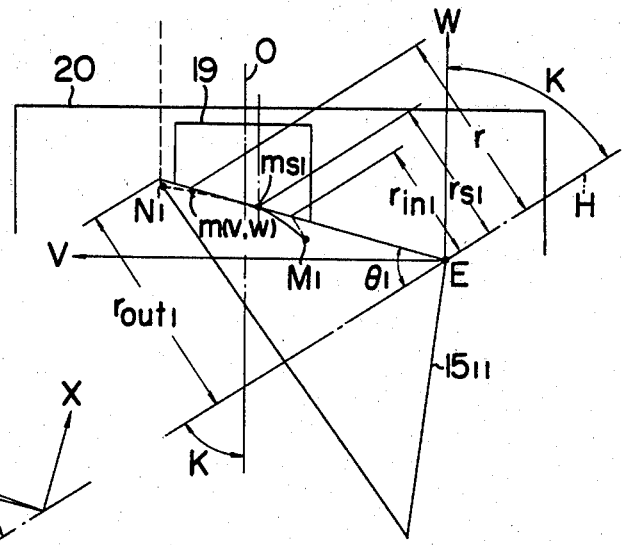
FIG. 10B

THEORETICAL IDEAL

THEORETICAL IDEAL

FIG.16A
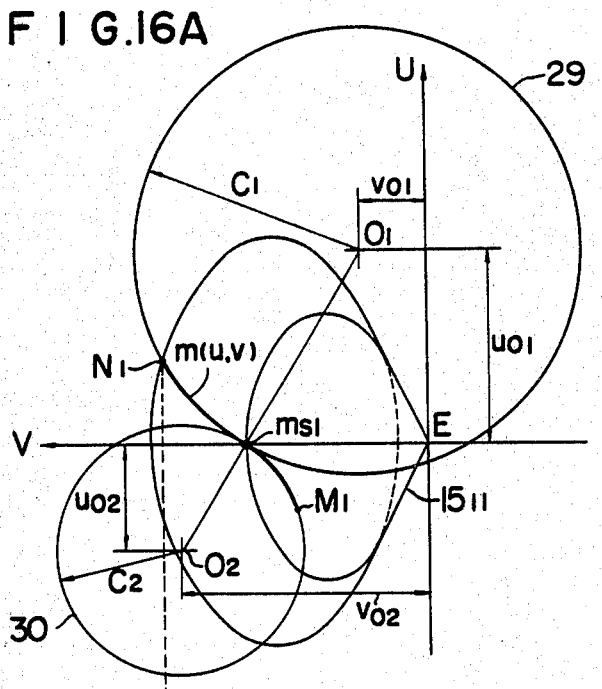
FIG. 16C
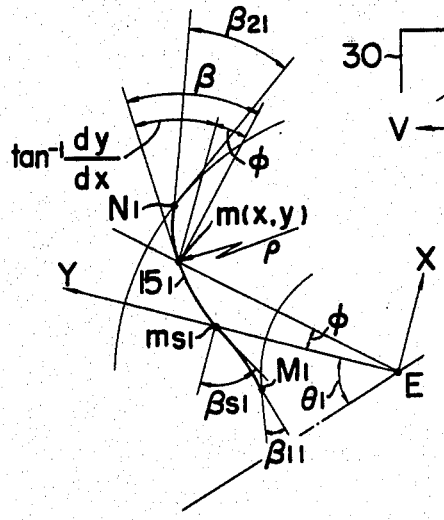
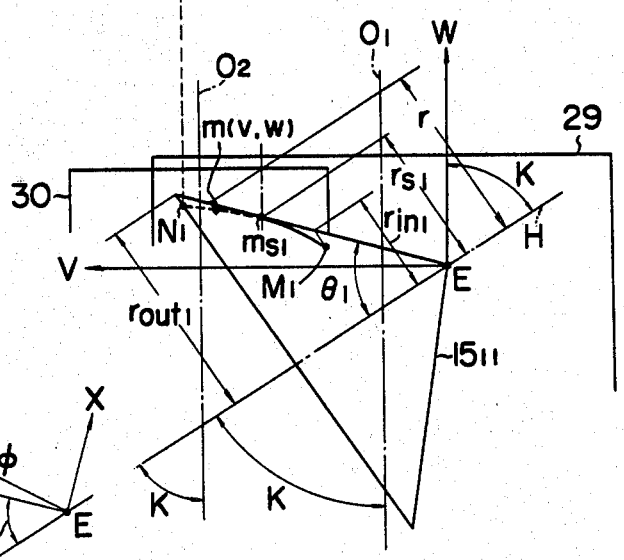
FIG. 16B

DIAGONAL-FLOW FAN WHEEL WITH BLADES OF DEVELOPABLE SURFACE SHAPE

This is a division of application Ser. No. 918,556 filed June 23, 1978, now U.S. Pat. No. 4,274,810.

BACKGROUND OF THE INVENTION

This invention relates generally to fans and blowers for gases and more particularly to diagonal-flow fans. More specifically, the invention relates to the construction of a novel impeller or fan wheel of a diagonal-flow fan of the so-called radial-plate type or limit-load type.

In the fan wheel of an ordinary centrifugal fan of the radial-plate type or the limit-load type, the entrance edges and exit edges of the blades are respectively parallel to the fan wheel rotational axis. When the fan wheel of the radial plate type fan is viewed in its axial direction, each blade is arcuately curved near its entrance edge in order to minimize impact loss at the entrance edge and then extends radially toward the exit edge. When the fan wheel of the limit-load type fan is viewed in its axial direction, each blade has a slight S-shaped or reflex curve as it extends toward the outer periphery of the fan wheel. However, each blade in either type of fan has no twist with respect to the axial direction, and cross section of the blades taken in parallel and spaced-apart planes perpendicular to the axis appear to be superposed on each other. Thus, each blade has a single-curvature or developable curved surface.

Furthermore, most of the cross sections of these blades with single-curvature surface in an ordinary radial-plate or limit-load type centrifugal fan have the shape of a single arc, or the shape of two arcs joined together. Accordingly, the fabrication of these blades is relatively simple. However, even in the case of a blade of this kind, a blade cross section shape in which the radius of the arc varies progressively along the chord length is close to the ideal shape from the viewpoint of fluid dynamics, but the fabrication of blades of such a shape is extremely difficult. For this reason, such blades have not as yet been reduced to practice except for centrifugal fans having blades of wing profiles (airfoil profiles) being manufactured in spite of this difficulty in order to utilize the advantages in efficiency and low noise level.

In contrast to a centrifugal fan as described above, a diagonal-flow fan has blades whose entrance edges and exit edges are not parallel to the rotational shaft axis, the radial distance from the shaft axis to each entrance edge varying progressively from one end of the entrance edge to the other, and furthermore, the radial distance from the shaft axis to each exit edge also varying progressively from one end of the exit edge to the other. In addition, each blade must be provided with a complicated double curvature which causes it to have a twist as viewed in the shaft axial direction. These and other features of diagonal-flow fans will be described in detail hereinafter, particularly in comparison with a centrifugal fan.

Theoretically, a diagonal-flow fan should have excellent performance but has not been reduced to practical use because of certain difficulties as will be described hereinafter.

SUMMARY OF THE INVENTION

It is an object of this invention to provide a fan wheel of a diagonal-flow fan of radial-plate type in which, by utilizing a part of a cylinder (which is a single-curvature surface or developable surface) and a plane for each blade of the fan wheel, an effect equivalent to that of blades of double-curvature surfaces which are close to the ideal from the viewpoint of fluid dynamics is attained to produce excellent fan performance, and, moreover, the difficulties accompanying the fabrication of diagonal-flow fan blades are overcome thereby to facilitate the production of the fan wheel.

It is another object of this invention to provide a fan wheel of a diagonal-flow fan of limit-load type in which parts of two cylindrical surface are used for each blade of the fan wheel thereby to obtain the highly desirable results recited above.

According to this invention, briefly summarized, there is provided a fan wheel of a diagonal-flow for propelling a flow of a gas, said fan wheel comprising a frustoconical main plate coaxially fixed to a rotational shaft, a frustoconical side plate spaced apart from the main plate and forming therebetween a diagonal flow path for the gas, and a plurality of fan blades each fixed at opposite side edges respectively to the inner surfaces of the main and side plates and having an inner entrance part and an outer exit part, each of said blades being made of a plate of a surface shape conforming to a portion of a combinations of imaginary developable surfaces joined to each other in an algebraically continuous manner, said surfaces having been caused to intersect imaginary, spaced apart and coaxial conical surfaces respectively corresponding to representative streamlines of the gas in the flow path thereby to form mutual intersection lines which substantially coincide respectively with smooth curves lying in corresponding conical surfaces of the representative streamlines and having respective shapes conforming to gas inflow angles of the entrance part and gas outflow angles of the exit part of the blade, at least said inflow angles varying progressively in accordance with the positions of the representative streamlines within the flow path, said smooth curves having radii of curvature which vary progressively between the entrance and exit parts, said portion of the combined developable surfaces being peripherally defined by the intersection lines at the streamlines at the main and side plates and by smooth continuous curves respectively passing through the ends of said smooth curves respectively at the entrance and exit parts of the blade.

The nature, utility, and further features of this invention will be more clearly apparent from the following detailed description with respect to preferred embodiments of the invention when read in conjunction with the accompanying drawings, which are briefly described below, and throughout which like parts are designated by like reference numerals and characters.

DRAWINGS

Figure 3:
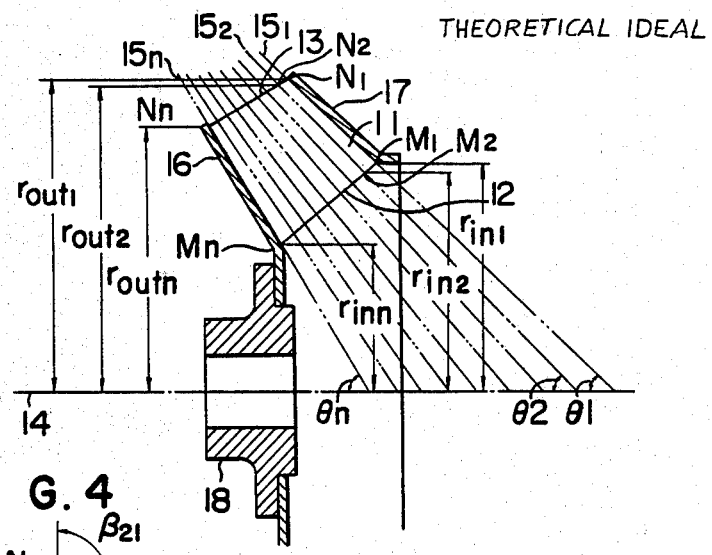
FIG. 3 is a side view similar to FIG. 1 showing a theoretically ideal example of a fan wheel of a diagonal-flow fan.
Figure 6:
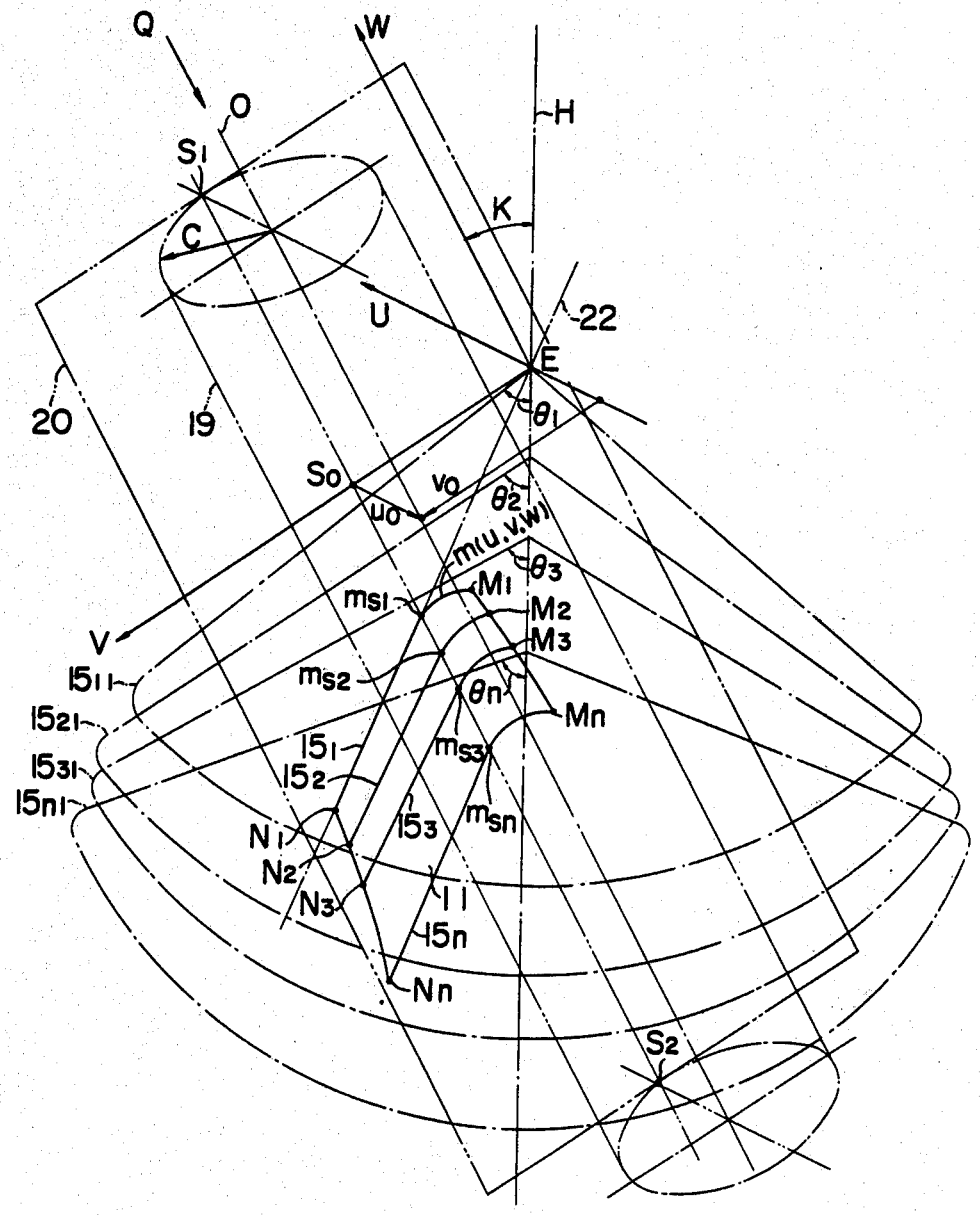
FIG. 6 is a graphical perspective view for a description of the fabrication of one example of a blade of the fan wheel according to this invention for radial-plate type fan.
Figure 8A:
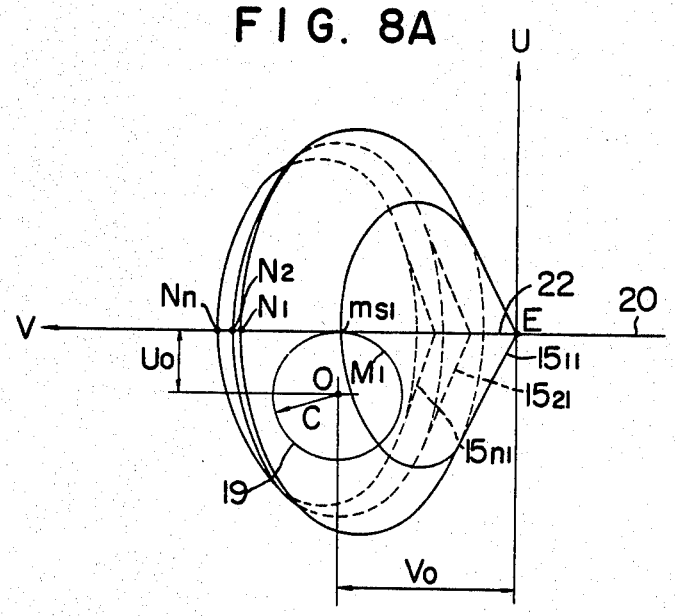
Figure 8B:
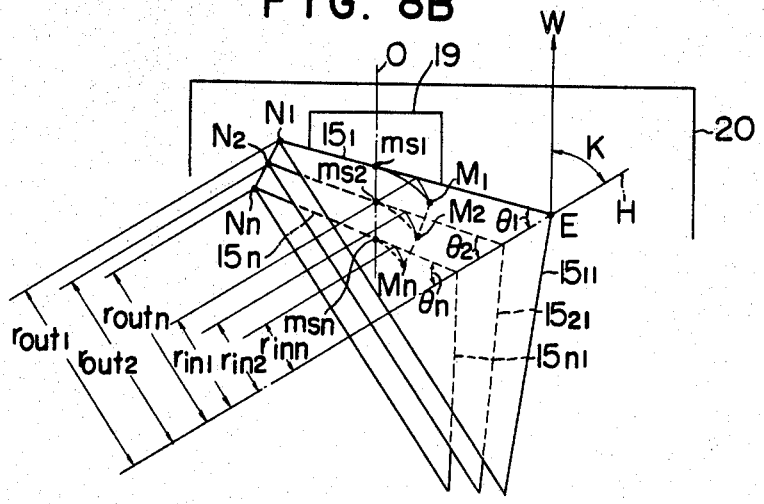
Figure 9:
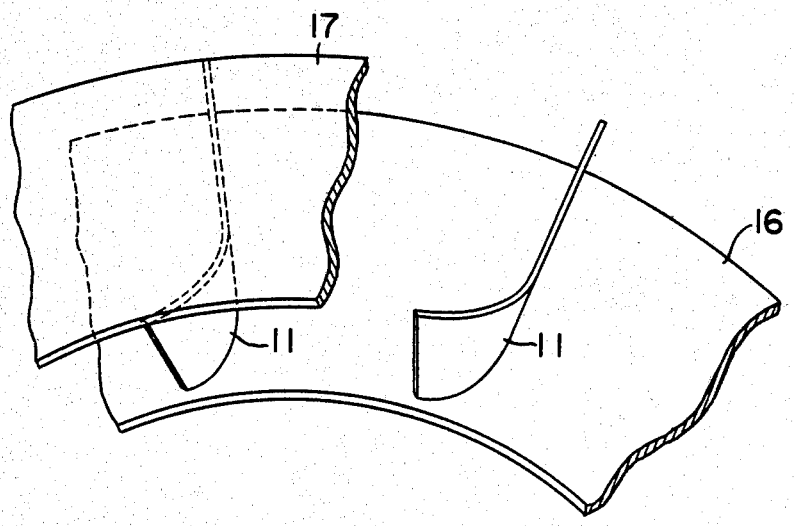
Figure 11:
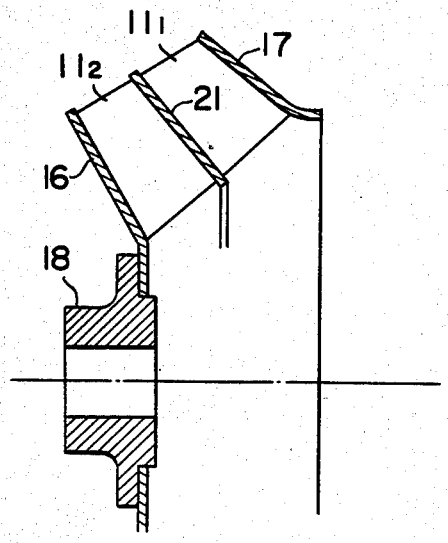
Figure 12:
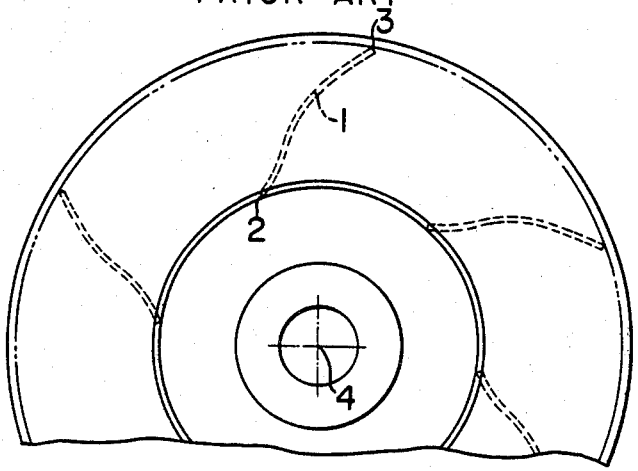
FIG. 12 PRIOR ART
Figure 13:
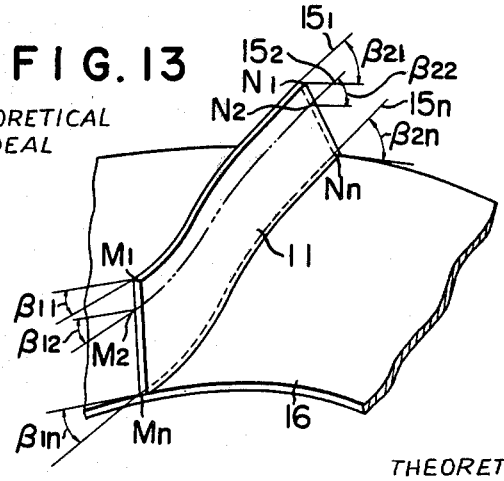
Figure 14:
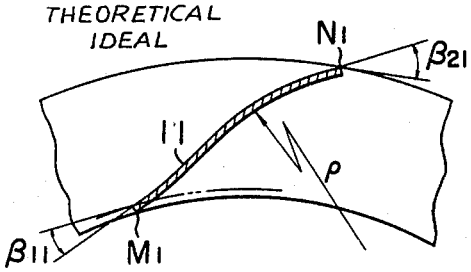
Figure 15:
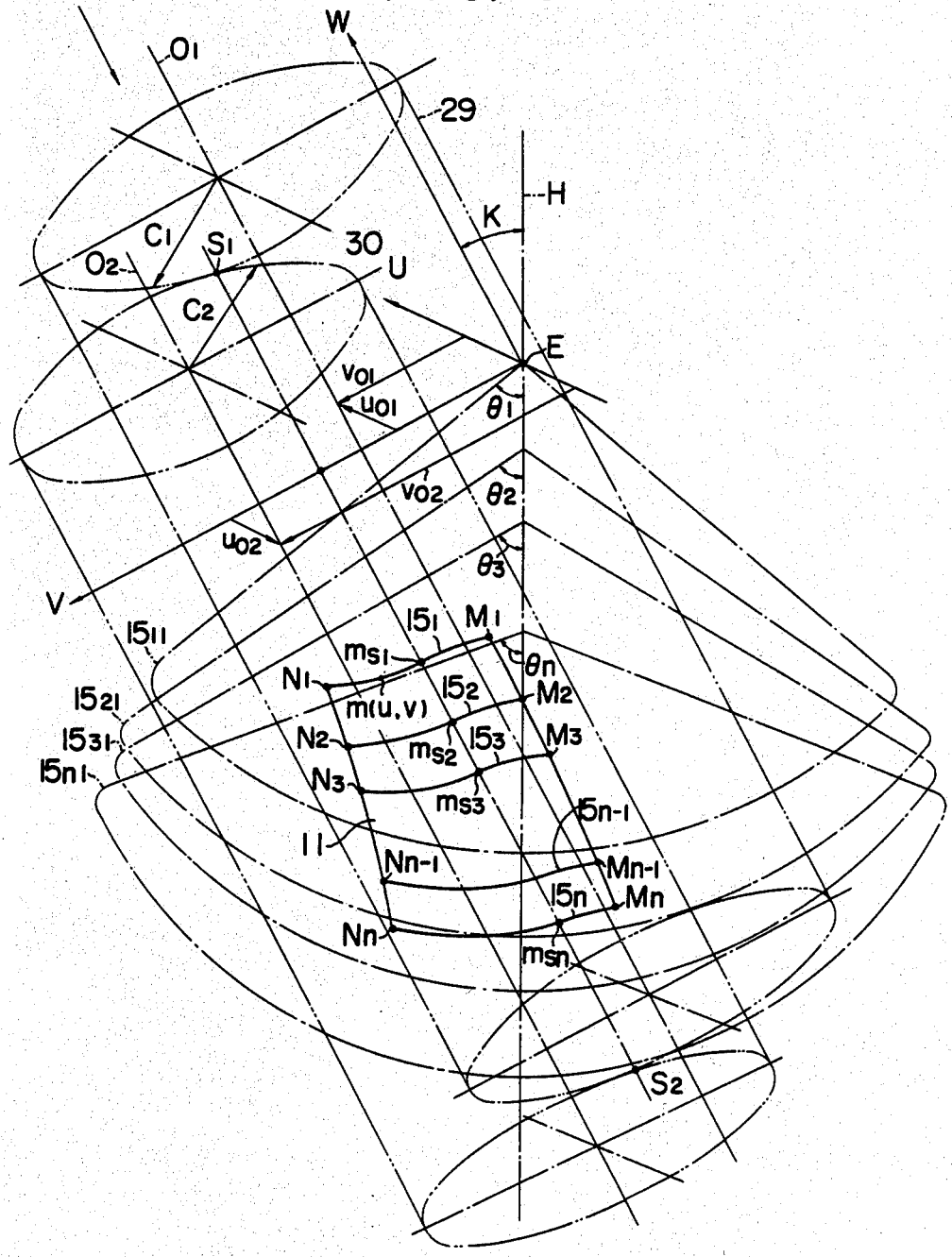
Figure 17A:
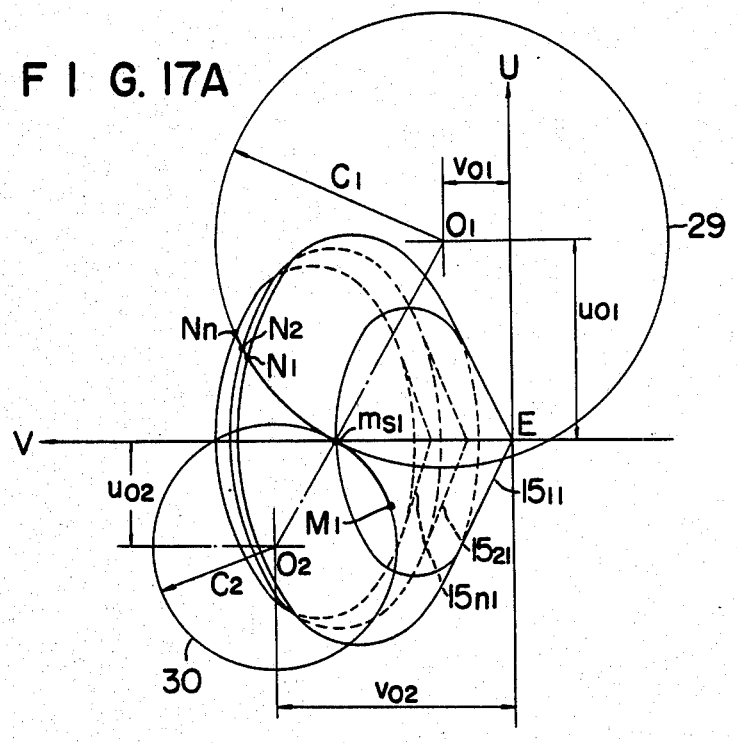
Figure 17B:
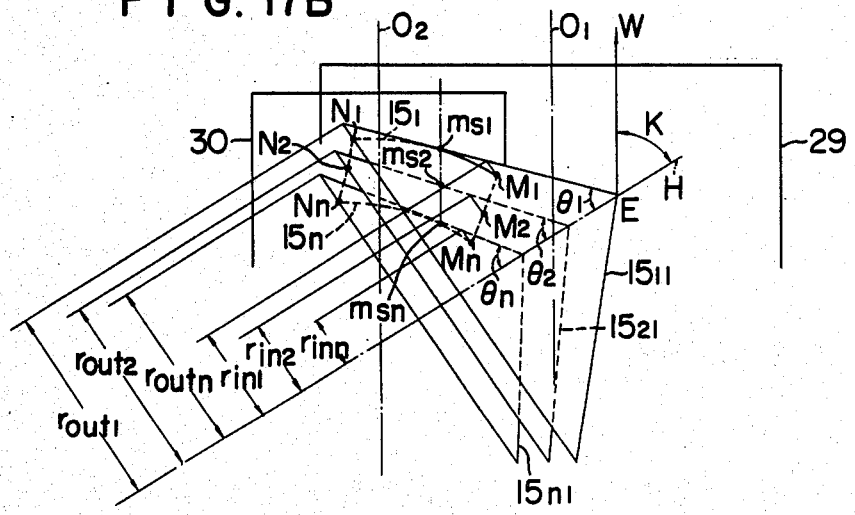
Figure 18:
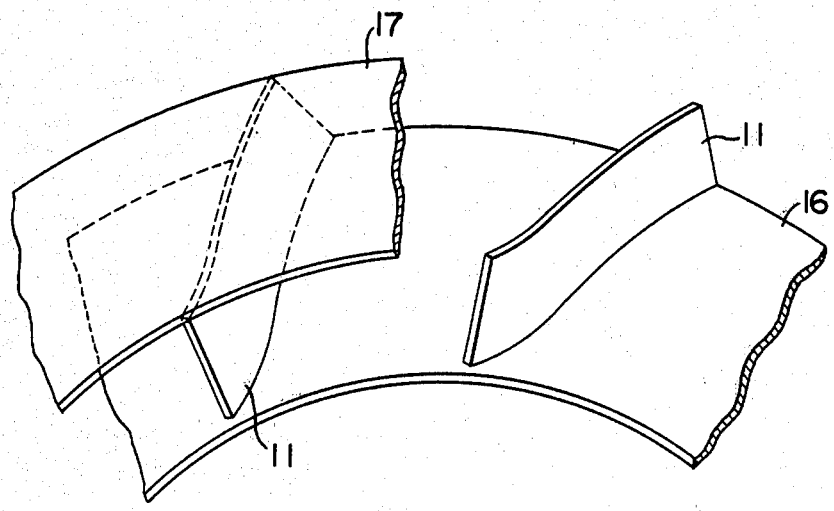

FIGS. 7A, 7B, and 7C are graphical views respectively for an explanation of the basic principle of this invention, particularly with respect to a blade as shown in FIG. 6;

FIGS. 8A and 8B are respectively vertical and horizontal projections of FIG. 6;

FIG. 9 is a fragmentary perspective view of one part of one example of the fan wheel of a diagonal-flow fan of radial-plate type according to this invention;

FIGS. 10A, 10B, and 10C are respectively projections for a description of the fabrication of another example of a fan wheel according to the invention;

FIG. 11 is a partial side view in section taken along a plane passing through the axis of rotation, of another example of a fan wheel of a diagonal-flow fan having an intermediate plate of conical shape; FIG. 12 is a partial axial view of a centrifugal fan of limit-load type;

FIG. 13 is a fragmentary perspective view showing a theoretically ideal and essential part of the fan wheel of a diagonal-flow fan of limit-load type;

FIG. 14 is a planar development of a conical surface which a representative streamline shown in FIG. 3 constitutes;

FIG. 15 is a graphical perspective view for a description of the fabrication of one example of a blade of the fan wheel according to this invention for a limit-load type fan;

FIGS. 16A, 16B, and 16C are graphical views respectively for an explanation of the basic principle of this invention particularly with respect to a blade as shown in FIG. 15;

FIGS. 17A and 17B are respectively vertical and horizontal projections of FIG. 15; and FIG. 18 is a fragmentary perspective view of one part of one example of the fan wheel of a diagonal-flow fan of limit-load type according to this invention.

DETAILED DESCRIPTION

As conductive to a full understanding of this invention, the differences between a centrifugal fan and a diagonal-flow fan and certain problems accompanying diagonal-flow fans, which were briefly mentioned hereinbefore, will first be described more fully.

Figure 1:
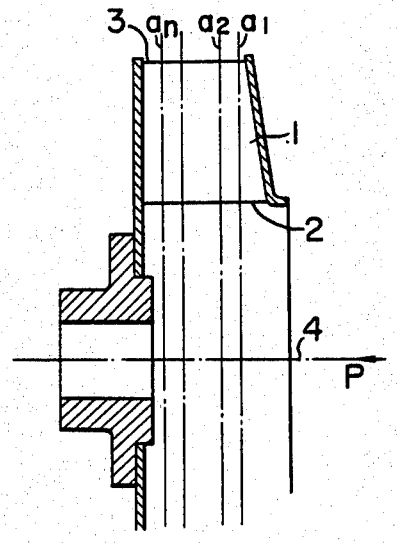
FIG. 1 PRIOR ART
FIG. 1 is a partial side view, in section taken along a plane passing through the axis of rotation, of a fan wheel of an ordinary centrifugal fan, either of the radial-plate type or of the limit load type.
Figure 2:
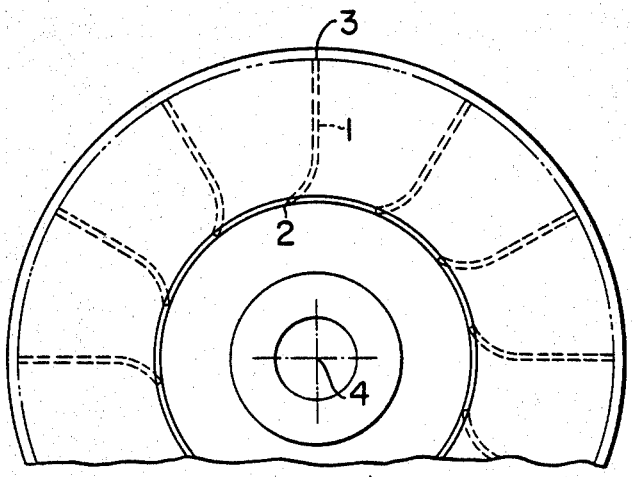
FIG. 2 PRIOR ART
FIG. 2 is a partial axial view of a centrifugal fan of the radial-plate type.

Referring first to FIG. 1, the fan wheel shown therein of an ordinary centrifugal fan has a number of blades 1, each having an entrance edge 2 and an exit edge 3 both of which are parallel to the rotational shaft axis 4. As viewed in the axial direction (arrow direction P), each blade 1 of a centrifugal fan of radial-plate type is arcuately curved in the vicinity of its entrance edge 2 in order to minimize impact or collision losses at the blade inlet and then continuously extends radially toward the exit edge 3 as shown in FIG. 2. On the other hand, with respect to a centrifugal fan of limit-load type, each blade 1 is, as viewed in the same direction P, curved in the shape of an elongated letter S from its entrance edge 2 to its exit edge 3 as shown in FIG. 12. However, in either type of centrifugal fan, each blade 1 has no twist in the direction of the shaft axis 4, and the sections of the blades respectively in spaced apart and parallel planes $a_1, a_2, \ldots a_n$ intersecting the shaft axis 4 at right angles appear to be superposed on each other. That is, each blade 1 may be considered to be a single-curvature surface or developable surface.

Figure 4:
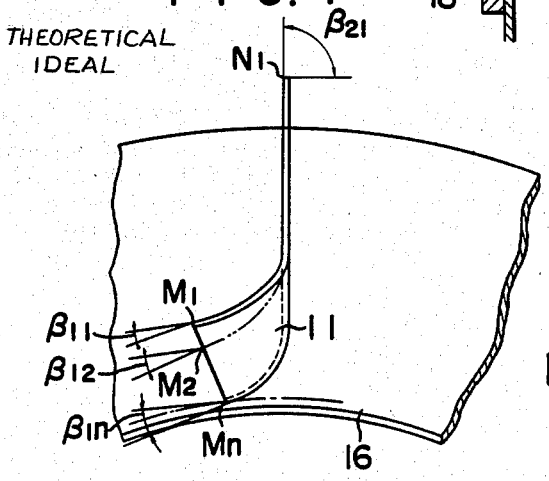
FIG. 4 is a fragmentary perspective view showing an essential part of the fan wheel of a diagonal-flow fan of the radial-plate type and of a side view as shown in FIG. 3.

Differing from a centrifugal fan, a diagonal-flow fan has a fan wheel with blades 11, whose entrance edges 12 and exit edges 13 are not parallel to the rotational shaft axis 14 as shown in FIG. 3, and the radial distance from the shaft axis 14 to the entrance edge 12 of each blade progressively varies as $r_{in1}, r_{in2}, \ldots r_{inn}$ respectively at positions corresponding to representative streamlines $15_1, 15_2, \ldots 15_n$ in the gas flow path within the fan wheel. Furthermore, the radial distance from the shaft axis 14 to the exit edge 13 of each blade progressively varies as $r_{out1}, r_{out2}, \ldots r_{outn}$. If these radii vary in this manner, the inflow angles at the entrance edge 12 for minimizing the collision loss for respective streamlines $15_1, 15_2, \ldots 15_n$ and the corrsponding outflow angles for evening out the pressure head must be progressively varied as $\beta_{11}, \beta_{12}, \ldots \beta_{1n}$ and $\beta_{21}, \beta_{22}, \ldots \beta_{2n}$, respectively, as indicated in FIG. 4, which shows a blade of the fan wheel of a diagonal-flow fan of radial-plate type; and in FIG. 13, which shows a blade of the fan wheel of a diagonal-flow fan of limit-load type (in the radial-plate type diagonal-flow fan, the outflow angles $\beta_{21}$ are often selected to be a constant value such as 90° as shown in FIG. 4 because it is possible to even out the pressure head by suitably selecting the ratios of $r_{out}$ to $r_{in}$ on respective streamlines). It will therefore be understood that in order to obtain an ideal fan performance, the shape of each blade must be made to assume a complicated twisted double-curvature surface as viewed in the direction of the axis 14.

That is, if the blades 11 of the fan wheel of the diagonal-flow fan were to be merely of the shape of a single-curvature which has a single arcuate curve or a curve comprising two arcuate curves similar to the blades 1 in a centrifugal fan as shown in FIG. 1 and FIGS. 2 or 12 and were to be mounted with inclinations in accordance with the inclination of the representative streamlines $15_1, 15_2, \ldots 15_n$, the fan performance would drop except in the case of extremely small fans. If, in order to improve the performance, an attempt were to be made to fabricate blades 11 of the shape of a twisted, double-curvature surface, the fabrication would be very difficult.

Basically considered, the fan wheels of fans of this character are fabricated, not by casting, but by assembling parts principally of rolled steel plates. Moreover, fans of a wide variety of dimensions, even up to large impellers of diameters of 3 to 4 meters, are produced in a great variety of kinds, each in small quantities. For this reason, it is very difficult to fabricate fan wheels of blades of the shape of a double-curvature surface at respective costs which are not prohibitive.

Because of the foregoing reasons, centrifugal fans as described have been and are being widely produced, whereas diagonal-flow fans requiring double-curvature blades 11 as shown in FIGS. 4 and 13 have not been reduced to practice in spite of the great expections for their high performance.

Before describing the invention, a geometrical analysis of the theoretical shape of the blades of diagonal-flow fans will be made.

As partly described hereinbefore in conjunction with FIG. 3, a plurality of blades 11 are fixed by welding between shroud-like main and side plates 16 and 17, and the main plate 16 at its radially inner part is secured to a hub 18. The representative streamlines $\mathbf{15}_1$, $\mathbf{15}_2$, . . . $\mathbf{15}_n$ (which are actually "streamsurfaces" but will be herein referred to as "streamlines") respectively are in the shapes of conical surfaces of half vertex angles $\theta_1$, $\theta_2$, . . . $\theta_n$. Each blade 11 begins from entrance points (inlets) $M_1$, $M_2$, . . . $M_n$ on these conical surfaces and ends at exit points (outlets) $N_1$, $N_2$, . . . $N_n$. When the conical surface constituted by one ($\mathbf{15}_1$) of the representative streamlines is developed in a planar surface, it appears as in FIG. 5, in which a section of only one blade 11 of the fan wheel of a diagonal-flow fan of radial-plate type is shown.

Figure 5:
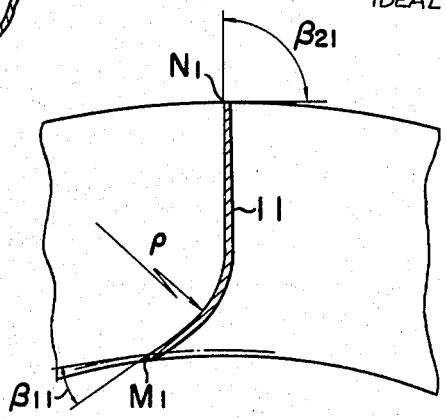
FIG. 5 is a planar development of a conical surface constituted by a representative streamline shown in FIG. 3.

This section of the blade 11 in FIG. 5 has a specific inflow angle $\beta_{11}$ at the entrance point $M_1$ and a specific outflow angle $\beta_{21}$ (90° in this case) at the exit point $N_1$ and, in between, has a shape resembling a part of an ellipse with a gradually varying radius $\rho$ of curvature in the vicinity of the entrance point $M_1$ and a straight-line shape extending radially toward the exit point $N_1$. The specific inflow angle $\beta_{11}$ and the radius $\rho$ of curvature of this blade 11 continually vary as $\beta_{12}$, $\beta_{13}$, . . . $\beta_{1n}$ as shown in FIG. 4 in correspondence with the transition of the representative streamlines $\mathbf{15}_2$, $\mathbf{15}_3$, . . . $\mathbf{15}_n$ as shown in FIG. 3. Accordingly, a complicated double-curvature surface is required for each blade 11, as was pointed out hereinbefore.

According to this invention, a shape of the blade closely approximating the above stated ideal shape of the blade is realized by the use of a single-curvature surface without using a complicated double-curvature surface. In order to constitute a single-curvature blade which satisfies the above stated geometrical requirements, this invention makes use of intersections between the above stated conical surfaces constituted by the representative streamlines and an imaginary cylindrical surface and an imaginary plane tangent to the cylindrical surface in the case of a blade of a diagonal-flow fan of radial-plate type and two imaginary cylindrical surfaces in the case of a blade of a diagonal-flow fan of limit-load type.

FIG. 6 is a graphical perspective view indicating intersections between conical surfaces $\mathbf{15}_{11}$, $\mathbf{15}_{21}$, $\mathbf{15}_{31}$, . . . $\mathbf{15}_{n1}$ constituted by the representative streamlines $\mathbf{15}_1$, $\mathbf{15}_2$, $\mathbf{15}_3$, . . . $\mathbf{15}_n$ shown in FIG. 3 and an imaginary cylindrical surface 19 of a radius C and an imaginary plane 20 tangent to the cylindrical surface, which are newly introduced. In FIGS. 7A, 7B, and 7C, the intersections between a conical surface $\mathbf{15}_{11}$ constituted by a representative streamline $\mathbf{15}_1$ and the cylindrical surface 19 and plane 20 are projectionally shown, only the single conical surface $\mathbf{15}_{11}$ being shown for the sake of simplicity.

For the following analysis, three-dimensional rectangular coordinate axes U, V, and W as shown in FIGS. 6, 7A, 7B, and 7C are used, the origin of this coordinate system being positioned at the vertex E of the conical surface $\mathbf{15}_{11}$. The W axis is taken to be parallel to the centerline O of the cylindrical surface 19 and to form an angle K with the centerline axis H of the conical surface $\mathbf{15}_{11}$, and the V axis is taken to be included in the plane 20 and to be superimposed on the point $m_{s1}$ of tangency between the cylindrical surface 19 and the plane 20, which point is on the curve $M_1 N_1$ when viewed in the W-axis direction (arrow direction Q in FIG. 6) as shown in FIG. 7A.

From the manner in which the W is taken, the angle K of inclination of the cylindrical surface 19 (i.e., of the centerline O thereof) with respect to the conical surface $\mathbf{15}_{11}$ can be represented by the angle between the W axis and the centerline axis H of the conical surface $\mathbf{15}_{11}$. This conical surface $\mathbf{15}_{11}$ is taken to be the same as the conical surface constituted by the representative streamline $\mathbf{15}_1$ in FIG. 3. The intersection line between this conical surface $\mathbf{15}_{11}$ and the cylindrical surface 19 and the plane 20, that is, that portion of the line of intersection which extends from the entrance point $M_1$, through the tangent point $m_{s1}$, to the exit point $N_1$, is indicated by a thick line. The view shown in FIG. 7C, which is a development of the conical surface $\mathbf{15}_{11}$ is equivalent to the representation in FIG. 5.

More specifically, in FIG. 5, the blade 11 has a specific inflow angle $\beta_{11}$ and a specific outflow angle $\beta_{21}$ (of 90° in this case) on the conical surface $\mathbf{15}_{11}$ of one representative streamline $\mathbf{15}_1$ and therebetween has a sectional profile in the shape of a smooth curve having a radius of curvature $\rho$ varying progressively in the vicinity of the entrance point $M_1$ and thereafter of a straight line extending radially. This sectional profile can be obtained geometrically by determining the coordinates $u_o$ and $v_o$ of the centerline O of the cylindrical surface 19 along the axes U and V, the inclination angle K, and the radius C shown in FIGS. 7A and 7B by a method described hereinafter. Here, it is to be noted that since the plane 20 includes the element 22 (FIG. 6) of the conical surface $\mathbf{15}_{11}$, the outflow angle $\beta_{21}$ at the exit point $N_1$ is 90°.

These relationships will now be geometrically studied. An arbitrary point m on the curve $M_1 N_1$ constituting one part of the intersection between the conical surface $\mathbf{15}_{11}$ of the representative streamline $\mathbf{15}_1$ and the cylinder 19 will be considered. This point m has coordinates (u,v) in FIG. 7A, coordinates (v,w) in FIG. 7B, and coordinates (x,y) in FIG. 7C, the coordinates (x,y) being based on orthogonal coordinate axes X and Y having their origin on the centerline axis H as shown in FIG. 7C. The axis Y is at the angle $\theta_1$ relative to the axis H and passes through the tangent point $m_{s1}$ and the exit point $N_1$.

In this case, the following relationships were found to exist as a result of our mathematical and geometrical analysis.

$$x=f(\theta_1, u, r) \quad (1)$$

$$y=f(\theta_1, u, r) \quad (2)$$

$$u=f(U_o V_o, K, \theta_1, C, r) \quad (3)$$

$$\phi=f(\theta_1, u, r) \quad (4)$$

Here, r is the distance of the point m from the centerline axis H as shown in FIG. 7B, and $\phi$ is the angle between the axis Y and a straight line passing through the point m(x,y) and the origin E of the axis Y as shown in FIG. 7C. Therefore, by substituting the equations (1) through (4) respectively into the relationships $$\rho = \left[1 + \left(\frac{dy}{dx}\right)^2\right]^{3/2} / \frac{d^2y}{dx^2} \quad (5)$$

$$\beta = \tan^{-1}\left(\frac{dy}{dx}\right) + \phi \quad (6)$$

which are derived through differential analysis known in the art, the radius of curvature $\rho$ and the flow angle $\beta$ at the point m in FIG. 7C are obtained.

When the point m is at the entrance point $M_1$, the corresponding angle $\beta$ coincides with the inflow angle $\beta_{11}$. When this point m is at the tangent point $m_{s1}$ of the cylindrical surface 19 and the plane 20, the corresponding angle $\beta$ concides with the outflow angle $\beta_{21}$ (of 90° in this case). Similarly, in the case where the arbitrary point m is on the straight line $m_{s1}$ $N_1$, which is one part of the mutual intersection between the plane 20 and the conical surface $\mathbf{15}_{11}$ constituted by the representative streamline $\mathbf{15}_1$, the coordinate u expressed by the above Eq. (3) becomes as indicated in Eq. (3)' given below, irrespective of the position of the point m.

$$u=0 \quad (3)'$$

Furthermore, Eqs. (5) and (6) respectively become as follows.

$$\rho=\infty\text{(infinity)} \quad (5)'$$

$$\beta=\beta_{s1}=\beta_{21}\text{(90° in this case)} \quad (6)'$$

The reason why the value of the flow angle $\beta_{s1}$ at the tangent point $m_{s1}$ comes out the same (90° in this case) whether it is derived by calculation with respect to the cylindrical surface 19 (i.e., the curve $M_1m_{s1}$) or whether it is derived by calculation with respect to the plane 20 (i.e., the straight line $m_{s1}$ $N_1$) is that the cylindrical surface 19 and the plane 20 are tangent at the cylindrical element $S_1$–$S_2$ (FIG. 6) including the tangent point $m_{s1}$. As a result, the intersection line from the entrance point $m_{s1}$, and to the exit point $N_1$ is algebraically continuous.

The radius $\rho$ of curvature varies gradually from the entrance point $M_1$ toward the tangent point $m_{s1}$. Therefore, the curve from the entrance point $M_1$ to the tangent point $m_{s1}$ becomes an ideal smooth curve in contrast to the blades of the fan wheel of a known centrifugal fan of the radial-plate type in which each blade has a curve comprising a single arc or, at the most, two arcs of different radii in the vicinity of the entrance point $M_1$.

Thus, the representative streamline $\mathbf{15}_1$ shown in FIG. 3 is obtained as indicated in outline form in FIG. 6. In the same manner, the representative streamlines $\mathbf{15}_2$, $\mathbf{15}_3$, . . . $\mathbf{15}_n$ are obtained respectively from the intersections of the cylinder 19 and plane 20 and the conical surfaces $\mathbf{15}_{21}$, $\mathbf{15}_{31}$, . . . $\mathbf{15}_{n1}$.

FIG. 8A shows a projection of this state as viewed in the arrow direction Q (FIG. 6). This projection corresponds to FIG. 7A. Furthermore, FIG. 8B is a projection corresponding to FIG. 7B. These intersection lines can be readily computed by carrying out with respect to the conical surfaces $\mathbf{15}_{21}$, $\mathbf{15}_{31}$, . . . $\mathbf{15}_{n1}$ operations similar to that with respect to the conical surface $\mathbf{15}_{11}$.

That is, FIGS. 8A and 8B are similar to FIGS. 7A and 7B but further have conical surfaces $\mathbf{15}_{21}$, $\mathbf{15}_{31}$, . . . $\mathbf{15}_{n1}$ having a common centerline axis H with the conical surface $\mathbf{15}_{11}$ and respectively having half vertex angles $\theta_2$, $\theta_3$, . . . $\theta_n$. These n conical surfaces $\mathbf{15}_{11}$, $\mathbf{15}_{21}$, . . . $\mathbf{15}_{n1}$ are arranged in the same manner as the n conical surfaces constituted by the representative streamlines $\mathbf{15}_1$, $\mathbf{15}_2$, . . . $\mathbf{15}_n$ in FIG. 3, and, moreover, the blade 11 shown in FIG. 3 is obtained as a part of the cylinder 19 of radius C and the plane 20 shown in FIG. 8.

In any fans, including diagonal-flow fans, if the gas flow rate, gas pressure and rotation speed are given, the radial distances from the shaft axis to the entrance and exit edges of each blade, inflow and outflow angles at the entrance and exit edges, and blade width in the direction transverse to the gas flow direction can be determined, as values on representative streamlines in the fan wheel, as a result of fluid-dynamic analyses. How the above values are determined is explained in available textbooks relating to fans.

As is apparent from FIGS. 6 and 8A, when the group of n conical surfaces inclined as shown is viewed in the axial direction of the cylinder 19 (the arrow direction Q in FIG. 6), the intersection lines, that is, the blade 11, coincides with a part of the single-curvature surface comprising the cylinder 19 of the radius C and the plane 20 and has no twist, appearing as a superimposition with the same sectional profile. By the absence of twist in the developable surfaces 19 and 20, progressively varying inflow and outflow angles at the entrance and exit parts are obtained, because the developable blade is cut obliquely as shown in FIG. 6 and in FIG. 10D, and because the thus cut blade is installed in the main and side plates 16 and 17 with its entrance and exit edges disposed at specific relations to the stream surfaces. When the conical surface $\mathbf{15}_{11}$ is developed into a planar surface, it becomes as shown in FIG. 7C, and the other conical surfaces $\mathbf{15}_{21}$, $\mathbf{15}_{31}$, . . . $\mathbf{15}_{n1}$ also can be similarly developed. The intersections due to these developments are not shown in FIG. 8, but, as indicated in outline form in FIG. 6, they respectively start at points $M_2$, $M_3$, . . . $M_n$, pass through the tangent points $m_{s2}$, $m_{s3}$, . . . $m_{sn}$, and end at point $N_2$, $N_3$, . . . $N_n$, having inflow angles $\beta_{12}$, $\beta_{22}$, . . . $\beta_{1n}$ and an outflow angle $\beta_{21}$, the inflow angle respectively differing slightly from the inflow angles $\beta_{11}$ at the streamline $\mathbf{15}_1$. Between the entrance and tangent points, the intersection lines are in the form of smooth curves being gradually varying radii $\rho$ of curvature.

The outflow angles of the intersections, that is, the representative streamlines $\mathbf{15}_2$, $\mathbf{15}_3$, . . . $\mathbf{15}_n$, are 90° (constant value) since the intersecting plane 20 passes through elements of the conical surfaces $\mathbf{15}_{21}$, $\mathbf{15}_{31}$, . . . $\mathbf{15}_{n1}$. The intersection lines, of course, are continuous curves in the algebraic sense also at the tangent points $m_{s2}$, $m_{s3}$, . . . $m_{sn}$ of the cylindrical surface 19 and the plane 20. That the inflow angles $\beta_{11}$, $\beta_{12}$, . . . $\beta_{1n}$ respectively differ slightly from each other is a natural result of the variation of the radial distance $r_{in}$ at the entrance point of each of the representative streamlines $\mathbf{15}_1$, $\mathbf{15}_2$, . . . $\mathbf{15}_n$ as described hereinbefore with respect to FIG. 3.

When all intersection lines, that is, all representative streamlines $\mathbf{15}_1$, $\mathbf{15}_2$, . . . $\mathbf{15}_n$ have been determined by calculation as described above, the figure enclosed by the curve $M_1$ $m_{s1}$ at the representative streamline $\mathbf{15}_1$, the curve $M_n$ $m_{sn}$ at the representative streamline $\mathbf{15}_n$, and the curve $M_1$ $M_n$ and the straight line $m_{s1}$ $m_{sn}$ straddling the remaining representative streamlines and the figure enclosed by the straight line $m_{s1}$ $N_1$ at the representative streamline $15_1$, the straight line $m_{sn}$ $N_n$ at the representative streamline $15_n$, and the straight line $m_{s1}$ $m_{sn}$ and the curve $N_1$ $N_n$ straddling the remaining representative streamlines are respectively cut out from a cylindrical blank corresponding to the cylindrical surface 19 of radius C and a planar plate blank corresponding to the plane 20. The locus of this cutting out can be readily understood from the coordinates of the point m, that is, m (u, v, w), in FIG. 7.

On another hand, the cutting out locus in the case of planar development can also be readily understood from the m point coordinates m (x, y). Accordingly, the figure enclosed the curves $M_1$ $N_1$, $N_1$ $N_n$, $M_n$ $N_n$, and $M_1$ $M_n$ may be cut out from a steel sheet, and the part from the entrance points $M_1$, $M_2$, . . . $M_n$ to the tangent points $m_{s1}$, $m_{s2}$, . . . $m_{sn}$ may be curved to a radius of C. In this case, since the tangent line of the cylindrical surface 19 of radius C and the plane 20 coincides with an element $S_1$–$S_2$ of the cylindrical surface 19, the fabrication of the blade by bending the steel sheet by means of rolls, for example, can be easily carried out.

In the above described manner, the blade 11 is cut out from the cylindrical surface 19 and the plane 20. Alternatively, a steel sheet cut out beforehand is curved to a radius c at its part corresponding the region near the entrance points. Then, as indicated in FIG. 9, blades 11 thus formed are assembled with the main plate 16 and the side plate 17 thereby to form a fan wheel. Thus, without using blades having double-curvature surfaces, which have been considered a requisite for diagonal-flow fans, a fan wheel with blades producing a performance equivalent to that of double-curvature blades is easily fabricated.

The two developable surfaces, such as a cylindrical surface 19 and a planar surface 20, are chosen depending on the type, performance and dimensions of a fan wheel to be produced. Because there are a number of predetermined standards of types, performances and dimensions of diagonal-flow fans, the coice of the two developable surfaces can be determined on the basis of such standard. How the blade is oriented with respect to the conical surfaces will be apparent from the discussion in the following paragraphs.

In designing a fan wheel according to this invention of a diagonal-flow fan of radial-plate, the representative streamlines $15_1$ through 15n as shown in FIG. 3 are first determined. From these, the half-vertex angles $\theta_1$ through $\theta_n$ of the conical surfaces are determined. Standard values based on common practice of the ratio of the inner and outer diameters of each blade have been determined in accordance with the gas flow rate and delivery pressure, and, therefore, the distribution of the inflow angle $\beta_1$ along the blade entrance edge 12 is determined from the rotational speed of the fan wheel.

The radial distance $r_s$ of the tangent point $m_s$ of the curved part and the straight-line part of the blade 11 is also made to equal a standard value based on experience. The distances $u_o$ and $v_o$ shown in FIGS. 6 and 7 are determined at once from the radius distance $r_{s1}$ of the tangent point $m_{s1}$ (FIG. 7B) when the inclination angle K and the cylindrical surface radius C have been determined. Accordingly, the remaining variables are K and C. These two variables K and C are so adjusted that the inflow angle $\beta_1$ at the entrance edge 12 will become a specific value. It is to be noted that the specific value of the inflow angle $B_1$ is predetermined.

After thus finally determining the angle K and the radius C as well as the coordinates $U_o$ and $V_o$, it is now possible to plot the entrance and exit points $M_1$ and $N_1$ and the tangent point $m_{s1}$ and to draw the curve $15_1$ on a blank cylinder 19. This curve $15_1$ can be readily determined from the coordinates of the point m, that is, m(u,v,w).

The thus determined positions of the entrance and exit points $M_1$ and $N_1$ on the cylinder become basic reference points from which the plotting of the other entrance and exit points $M_2$, $M_3$, . . . $M_n$ and $N_2$, $N_3$, . . . $N_n$ starts. The next procedure is to determine the positions of the adjoining entrance and exit points $M_2$ and $N_2$ on the line of intersection or curve $15_2$. The determination of the position of the point $M_2$ is made by so adjusting the inner radial distance thereof from the shaft axis with respect to the conical surface $15_{21}$, in which the intersection line $15_2$ lies, on the basis of the determined values of the angle K, the radius C and the coordinates $U_o$ and $V_o$ as to obtain the predetermined inflow angle $\beta_{12}$. If the thus determined position of the point does not coincide substantially with an expected position, a different combination of the values of K and C is adopted and the same procedure as above stated is repeated. The same procedure is repeated for the other conical streamline surfaces to determine the positions of the other points. It will be understood that the determination of the exit points can be easily made since the outflow angle is constant.

For convenience in design, data may be prepared in advance in the above described manner as design information so that, when the inflow angle and the ratio of the inner and outer diameters of the fan wheel are given, the essential dimensions can be immediately determined. For example, in the case of an inner-to-outer diameter ratio $\lambda$ and a conical half vertex angle $\theta$, a graph with the inclination angle K as the abscissa, the inflow angle $\beta_1$ as the ordinate, and the cylindrical surface radius C as a parameter may be prepared beforehand.

In the above description, the line of intersection $15_1$ at one end was made a reference curve for a purpose of simplicity. However, in practical design, the reference curve is selected not from the line of intersection at one end but from the line in the middle of the blade. The use of such middle line as a reference curve is advantageous because it represents a mean streamline.

In practice, the plotting of the entrance and exits points as well as the drawing of the contour line of the blade on a blank can be made manually, but this procedure is most advantageously carried out by a computerized apparatus.

In the foregoing disclosure, the case wherein the plane 20 is so set that elements of the conical surfaces lie in that plane thereby to set the outflow angle $\beta_2$ at the constant value of 90° has been described. If necessary, however, the various dimensions can be determined by similar calculation also for the case wherein the outflow angle $\beta_2$ progressively varies. For example, in the case where the outflow angle $\beta_2$ is caused to vary progressively along the exit edge 13 for some purpose such as attaining an even more uniform pressure head at the exit edge 13 or a improvement in performance, the flow angle $\beta_s$ at the tangent point $m_s$ of the cylindrical surface 19 and the plane 20 is made smaller (or greater) than 90°. The intersection drawing corresponding to FIG. 7 in this case is shown in FIG. 10. Here, the plane 20 is so set that it is parallel to the W axis and, moreover, intersects the V axis with a certain angle at a point $S_o$ (FIG. 6) on the V axis.

Thereafter, the intersection lines of the conical surfaces $15_{11}$, $15_{21}$, . . . $15_{n1}$ and the cylindrical surface 19 and the plane 20 are obtained by the same method. Then, the outflow angle $\beta_2$ of the blade 11 progressively varies as $\beta_{21}$, $\beta_{22}$, . . . $\beta_{2n}$ at the intersection points, and, further, as shown in FIG. 10C, the curve from the tangent point $m_s$ to the exit point N also becomes a smooth curve (a rearwardly curved line in this case) wherein the radius of curvature varies gradually. Of course, the blade 11 has an algebraically continuous curve at the tangent points $m_{s1}$ through $m_{sn}$ of the cylindrical surface 19 and the plane 20.

Figure 10D:
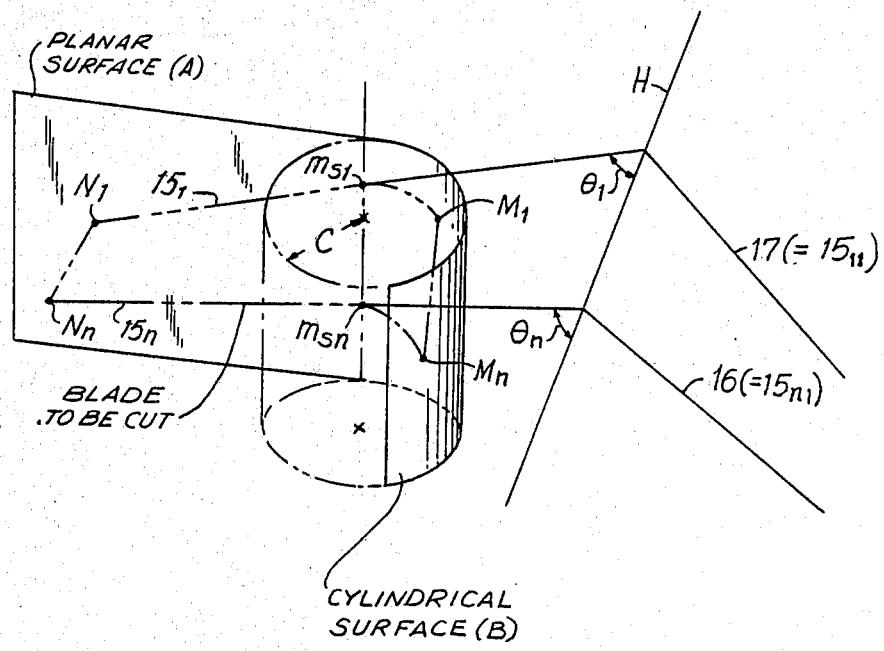

With respect to FIG. 10, a plate blank such as shown in FIG. 10D is prepared. Since this blank is made of developable surfaces (A) and (B), it is easy to produce such blank. On the other hand, basic mathematical calculations are made from the coordinates of the point m (u,v,w) (FIG. 7) on the basis of predetermined values such as those referred to hereinfore, and as a result of the calculations the locus of cutting of the blank with respect to the origin E of the coordinate system can be determined for producing the shape ($M_1$-$N_1$-$N_n$-$M_n$) of the blade shown in FIG. 10D.

Alternatively, the blade shape can be cut from a planar plate and then a portion thereof is curved into a cylindrical form to obtain the blade shown in the enclosed sketch. In practice the cutting operation is carried out by a computerized apparatus.

FIG. 11 illustrates one example of construction of a fan wheel wherein an intermediate plate 21 of conical shape is further installed between the main plate 16 and the side plate 17 in the fan wheel shown in FIG. 3, and all blades 11 are divided by this intermediate plate 21 into sections $11_1$ and $11_2$. Depending on the circumstances, a plurality of intermediate plates can be similarly installed thereby to divide the blades 11 into a greater number of sections.

The reason for such a measure is that, in the case where the requirements for variations of the inflow angles $\beta_{11}$ through $\beta_{1n}$ and the outflow angles $\beta_{21}$ through $\beta_{2n}$ cannot be satisfied for all of the representative streamlines $15_1$ through $15_n$ related to each blade 11 with only a single cylinder 19 and a single plane 20, blades produced by intersections with a plurality of mutually different cylinders and planes are afforded by this measure. Another reason is that, by this construction, the strength of the fan wheel itself is increased by the insertion of the intermediate plate 21.

This invention can be applied also to the fan wheel of a diagonal-flow fan of the limit-load type, as will now be described in conjunction with FIGS. 13 through 18. The general structural features of a fan wheel of a fan of this type are similar to those of a fan wheel of a diagonal-flow fan of the radial-plate type described in the foregoing disclosure and, therefore, will not be described again.

A planar development of the conical surface $15_{11}$ representing the representative streamline $15_1$ in FIG. 3 is shown in FIG. 14 and shows a chordwise section of a blade 11. This blade section has a specific inflow angle $\beta_{11}$ at the entrance point $M_1$ and a specific outflow angle $\beta_{21}$ at the exit point $N_1$ and has between these two points a curved shape resembling a portion of an ellipse with a gradually varying radius $\rho$ of curvature. The inflow angle $\beta_{11}$ of this blade 11 varies progressively as $\beta_{12}$, $\beta_{13}$, . . . $\beta_{1n}$ as indicated in FIG. 13 in correspondence to the representative streamlines $15_2$, $15_3$, . . . $15_n$ of FIG. 3 and the radius $\rho$ of curvature also varies. For this reason, the blade 11 is required to have a complicate double-curvature surface shape. This double-curvature blade shape is closely approximated by the blade 11 according to this invention which is obtained in the following manner.

FIG. 15 is a graphical perspective view showing intersections between coaxial conical surfaces corresponding to the representative streamline $15_1$, $15_2$, . . . $15_n$ shown in FIG. 3 and newly introduced two imaginary cylindrical surfaces 29 and 30 circumscribing each other. In FIGS. 16A, 16B, and 16C, the intersections between a conical surface corresponding to the representative steamline $15_1$ and the cylindrical surfaces 29 and 30 are projectionally indicated. For the following analysis, three-dimensional, rectangular coordinate axes U, V, and W, similar to those used in the description of the preceding embodiment of the invention, are used. The origin of this coordinate system is positioned at the vertex E of the conical surface $15_{11}$. The W axis is made to be parallel to the centerline $O_1$ of the cylindrical surface 29 and to the centerline $O_2$ of the cylindrical surface 30, and the V axis is taken to be superimposed on the point $m_{s1}$ of tangency between the cylindrical surfaces 29 and 30 on the curve $M_1$ $N_1$ when viewed in the W-axis direction (arrow direction Q in FIG. 15) as shown in FIG. 16.

As indicated in FIG. 15, the coordinates relative to these coordinate axes U, V, and W of the centerline $O_1$ of the cylindrical surface 29 of radius $C_1$ in the U-axis and V-axis directions are respectively $u_{o1}$ and $v_{o1}$, while the coordinates of the centerline $O_2$ of the cylindrical surface 30 of radius $C_2$ in the U-axis and V-axis directions are respectively $u_{o2}$ and $v_{o2}$. Furthermore, the centerlines $O_1$ and $O_2$ of these two cylindrical surfaces 29 and 30 are inclined by the same angle K relative to the centerline H of the conical surface $15_{11}$ of a half vertex angle of $\theta_1$. At the same time, these two cylindrical surfaces 29 and 30 are mutually tangent along a common cylindrical element $S_1S_2$ passing through a point S on the V axis.

From the manner in which the W axis is taken as described above, the inclination angle K of the cylinder 29 can be expressed by the angle between the W axis and the centerline H of the conical surface $15_{11}$. The conical surface $15_{11}$ is the same as the conical surface constituted by the representative streamline $15_1$ in FIG. 3. The intersection line of this conical surface $15_{11}$ with the two cylindrical surfaces 29 and 30, that is, that portion of the tangency line from the entrance point $M_1$, through the tangent point $m_{s1}$, to the exit point $N_1$, is indicated by a thick-line curve in the development of the conical surface $15_{11}$ in FIG. 16C, and this curve is equivalent to the curve of the blade 11 in FIG. 14.

More specifically, the sectional profile of the blade 11 as shown in FIG. 14 has specific inflow and outflow angles $\beta_{11}$ and $\beta_{21}$ on a conical surface $15_{11}$ of one representative streamline $15_1$, and the entrance point $M_1$ and the exit point $N_1$ are joined by a smooth, elongated S-shaped curve having a radius of curvature which varies progressively. This sectional profile of the blade 11 can be geometrically derived by determining the distances $u_{o1}$, $v_{o1}$, $u_{o2}$, and $v_{o2}$, the inclination angle K, and the radii $C_1$ and $C_2$ by the method described hereinafter.

These relationships can be geometrically considered similarly as described hereinbefore in the preceding embodiment of the invention with respect to Eqs. (1) through (6) set forth hereinbefore.

For example, in the case where any point m is disposed on the arcuate curve $m_{s1} N_1$, which is a part of the intersection line between the conical surface $15_{11}$ constituted by the representative streamline $15_1$ and the cylindrical surface 29, is considered, the same theory can be applied directly except that Eq. (3) set forth hereinbefore merely changes into the following form.

$$u=f(u_{o1}, v_{o1}, K, \theta_1, C_1, r) \quad (3a)$$

As a result, the radius $\rho$ of curvature and the flow angle $\beta$ of the point m in FIG. 16C is obtained. When the point m is at the tangent point $m_{s1}$, the angle $\beta$ at that time coincides with the flow angle $\beta_{s1}$ at the point of inflection of the S figure, and when point m is at the exit point $N_1$, the angle $\beta$ at that time coincides with the outflow angle $\beta_{21}$.

Similarly, in the case where any point m is disposed on the arcuate curve $M_1 m_{s1}$, which is a part of the intersection line between the conical surface $15_{11}$ constituted by the representative streamline $15_1$ and the cylindrical surface 30, is considered, the above described theory can be applied directly except that Eq. (3) set forth hereinbefore merely changes into the following form.

$$u=f(u_{o2}, v_{o2}, K, \theta_1, C_2, r) \quad (3b)$$

Accordingly, when the point m is at the entrance point $M_1$, the angle $\beta$ at that time coincides with the inflow angle $\beta_{11}$, and when the point m is at the tangent point $m_{s1}$, the angle $\beta$ at that time coincides with the flow angle $\beta_{s1}$ at the point of inflection of the S figure. Since the two cylindrical surfaces 29 and 30 are mutually tangent along their elements $S_1$–$S_2$, this flow angle $\beta_{s1}$ at this tangent point (point of inflection) comes out to be the same value whether it is calculated on the basis of its being on the cylindrical surface 29 (on the curve $m_{s1} N_1$) or whether it is calculated on the basis of its being on the cylindrical surface 30 (on the curve $M_1 m_{s1}$). As a result, it is evident that the curve $M_1 N_1$ of S shape is an algebraically continuous curve.

Furthermore, as the point m is considered to move from the entrance point $M_1$ to the exit point $N_1$, the radius of curvature $\rho$ varies gradually. For this reason, the S-shaped curve from the entrance point $M_1$ to the exit point $N_1$ is a smooth curve approaching the ideal shape, in contrast to the fan wheel of a conventional centrifugal fan of limit-load type wherein each of the curved parts of the S-shaped figure comprises a single arc or two arcs, at the most, joined together.

In the above described manner, the representative streamline $15_1$ shown in FIG. 3 is obtained as indicated in outline form in FIG. 15. In the same manner, the other representative streamlines $15_2, 15_3, \ldots, 15_n$ shown in FIG. 3 are obtained as respective intersection lines between the cylindrical surfaces 29 and 30 and the conical surfaces $15_{21}, 15_{31}, \ldots, 15_{n1}$.

FIG. 17A is a projection of this state as viewed in the arrow direction Q in FIG. 15. This projection corresponds to FIG. 16A, and, further, FIG. 17B corresponds to FIG. 16B. These intersection lines can be readily obtained through calculation by carrying out, with respect to the conical surfaces $15_{21}, 15_{31}, \ldots 15_{n1}$, operations similar to tht carried out with respect to the conical surface $15_{11}$.

That is, FIGS. 17A and 17B are equivalent to FIG. 16 with the addition of the conical surfaces $15_{21}, 15_{31}, \ldots 15_{n1}$ coaxially disposed relative to the conical surfaces $15_{11}$ with the centerline axis H as a common centerline and respectively having half vertex angles $\theta_2, \theta_3, \ldots \theta_n$. These n conical surfaces $15_{11}, 15_{21}, \ldots 15_{n1}$ are arranged similarly as the n conical surfaces constituted by the representative streamlines $15_1, 15_2, \ldots 15_n$ of FIG. 3, and, moreover, the blade 11 of FIG. 3 is substituted into a part of the cylindrical surface 29 of radius $C_1$ and the cylindrical surface 30 of radius $C_2$ shown in FIG. 17.

As is apparent also from FIGS. 15 and 17A, when the intersection lines on the n conical surfaces are viewed in the axial direction of the cylindrical surfaces 29 and 30 (arrow direction Q in FIG. 15), the intersection lines, that is, the blade 11, is a part of a single-curvature (developable) surface constituted by the cylindrical surface of radius $C_1$ and the cylindrical surface of radius $C_2$, having no twist, and appears as a superimposition of the same sectional profiles. When the conical surface $15_{11}$ is developed into a plane, it becomes as shown in FIG. 16C as mentioned hereinbefore.

The conical surfaces $15_{21}, 15_{31}, \ldots 15_{n1}$ can also be developed in the same manner. The intersection lines due to these developments begin at the entrance points $M_2, M_3, \ldots M_n$, pass through the tangent points (inflection points) $m_{s2}, m_{s3}, \ldots m_{sn}$, and terminate at the exit points $N_2, N_3, \ldots N_n$, as indicated in outline form in FIG. 15 although not shown in FIG. 17. These intersection lines respectively have inflow angles $\beta_{12}, \beta_{13}, \ldots \beta_{1n}$ and outflow angles $\beta_{22}, \beta_{23}, \ldots \beta_{2n}$ which respectively differ progressively by small differences from the inflow angle $\beta_{11}$ and the outflow angle $\beta_{21}$ corresponding to the representative streamline $15_1$, and the entrance points and the corresponding exit points are respectively joined by smooth curves of radii of curvature $\rho$ which gradually vary.

All intersection lines, of course, are algebraically continuous also at the tangent points $m_{s2}, m_{s3}, \ldots m_{sn}$ of the cylindrical surfaces 19 and 20. That the inflow angles $\beta_{11}, \beta_{12}, \ldots \beta_{1n}$ and the outflow angles $\beta_{21}, \beta_{22}, \ldots \beta_{2n}$ respectively differ slightly from each other is a natural result of the variations of the radial distance $r_{in}$ at the entrance point and the radial distance $r_{out}$ at the exit point of each of the representative streamlines $15_1, 15_2, \ldots 15_n$ as described hereinbefore with reference to FIG. 3.

When all intersection lines, that is, a representative streamlines $15_1, 15_2, \ldots 15_n$ have been operationally determined, the part enclosed by the curve $m_{s1} N_1$ at the representative streamline $15_1$, the curve $m_{sn} N_n$ at the representative streamline $15_n$, and the curve $N_1 N_n$ and the straight line $m_{s1} m_{sn}$ straddling all representative streamlines is cut out from the cylindrical surface 29 of radius $C_1$. The part enclosed by the curve $M_1 m_{s1}$ at the representative streamline $15_1$, the curve $M_n m_{sn}$ at the representative streamline $15_n$, and the curve $M_1 M_n$ and the straight line $m_{s1} m_{sn}$ straddling all representative streamlines is cut out from the cylindrical surface 30 of radius $C_2$. The path or outline of this cutting out operation can be readily determined from the coordinates of the point m, that is, m (u,v,w).

On another hand, the cutting out path in the case of development into a planar figure can be readily determined in a similar manner from the coordinates of the point m, that is, m (x,y). For this reason, the blade 11 may be produced by first cutting out from a flat sheet of steel a part enclosed by the curves $M_1 N_1$, $N_1 N_n$, $M_n N_n$, and $M_1 M_n$ and then curving this cut-out steel sheet with the radius $C_1$ and the radius $C_2$ thereby to impart the S shape thereto.

In this case, since the line of juncture of the cylindrical surfaces 29 and 30 of radii $C_1$ and $C_2$, respectively, is an element of each of these cylindrical surfaces, the blade 11 can be easily fabricated by curving the steel sheet by rolling, for example.

The blade 11 is thus cut out from the cylindrical surfaces 29 and 30 or is cut out from a flat steel sheet and then curved into the S shape with the radii $C_1$ and $C_2$. By assembling a designed number of these blades 11 together with a main plate 16 and a side plate 17 as indicated in FIG. 18, there is obtained a diagonal-flow fan of a performance equivalent to that of a fan wheel provided with blades of double-curvature surface, which were considered to be requisite for the fan wheel of a diagonal-flow fan. Thus, this high-performance fan wheel can be easily produced.

In actually designing a fan wheel according to this embodiment of the invention of a limit-load type, diagonal-flow fan, the representative streamlines $\mathbf{15}_1$ through $\mathbf{15}_n$ are first determined. From these, the conical surface half vertex angles $\theta_1$ through $\theta_n$ are determined. Standard values of the ratio of the inner and outer diameters of each blade have been tentatively determined in accordance with the gas flow rate and delivery pressure. Therefore, from the rotational speed of the fan wheel, the distribution of the inflow angle $\beta_1$ along the blade entrance edge 12 and the distribution of the outflow angle $\beta_2$ along the blade exit edge 13 are determined.

Furthermore, for the flow angle $\beta_s$ at the point of inflection $m_s$, a value based on experience has been determined as a standard value. When the inclination angle K and the radii $C_1$ and $C_2$ of the cylindrical surfaces 29 and 30 have been determined, the distances $u_{o1}$, $v_{o1}$, $u_{o2}$, and $v_{o2}$ are readily determined from the radial distance $r_{s1}$ (FIG. 16B) of the inflection point $m_{s1}$ and the flow angle $\beta_{s1}$. Accordingly, the remaining variables are K, $C_1$, and $C_2$. K and $C_2$ become variables at the entrance point $M_1$, and K and $C_1$ become variables at the exit point $N_1$. These three variables K, $C_1$, and $C_2$ are selected at values such tht the outflow angle $\beta_2$ at the exit edge 13 and inflow angle $\beta_1$ at the entrance edge 12 will be of respective specific values.

For convenience in design, similarly as in the example of the diagonal-flow fan of radial-plate type described hereinbefore, data may be prepared in advance in the above described manner as design information so that, when the inflow and outflow angles and the ratio of the inner and outer diameters of the fan wheel are given, the essential dimensions can be immediately determined. For example in the case of an inner-to-outer diameter ratio $\lambda$, a conical half vertex angle $\theta$, and a flow angle $\beta_2$ at the inflection point of the S figure, it is advantageous to prepare in advance a graph with the cylindrical radius $C_1$ as a parameter, the inclination angle K as the abscissa, and the outflow angle $\beta_2$ as the ordinate and a graph with the cylindrical radius $C_2$ as a parameter, K as the abscissa, and inflow angle $\beta_1$ as the ordinate. In using these two graphs, of course, common values of the inclination angle K must be used.

As in the preceding embodiment of this invention, an intermediate plate 21 of frustoconical shape can be further installed as illustrated in FIG. 11, whereby the various advantages feature described hereinbefore are afforded.

In accordance with this invention, as described above, blades each of a single-curvature (developable) surface, which is a portion of a cylindrical surface, are used instead of blades each of double-curvature (undevelopable) surface, which was heretofore considered to be indispensable, in the fan wheel of a diagonal-flow fan, whereby a fan performance equivalent to that of a fan provided with ideal double-curvature blades can be attained.

That is, the inflow angles and outflow angles of each blade vary progressively in accordance with the positions taken in the gas flow path by the representative streamlines within the fan wheel. In addition, each curve extending from the corresponding entrance point to the exit point also has a shape which is not a simple arc with a single radius of curvature or, at the most, a curve formed by joining two arcs as in centrifugal fans but is a curve which is close to the ideal according to fluid dynamics and has a radius of curvature varying progressively over the entire chord length.

What we claim is:

1. A fan wheel of a diagonal-flow fan for propelling a flow of a gas, said fan wheel comprising a rotational shaft; frustoconical main plate (16) coaxially fixed to the shaft, a frustoconical side plate (17) coaxially fixed with respect to the axis (14) of rotation of the shaft and spaced apart from the main plate to form therebetween a diagonal flow path for the gas, the cone angle of the main plate (16) being greater than the cone angle of the side plate (17), and a plurality of fan blades (11) each fixed at respective opposite side edges to the inner surfaces of the main and side plates (16,17) and having an inner entrance part and an outer exit part, said parts extending substantially transverse to said diagonal flow path, each of said fan blades (11) comprising a plate of a surface shape conforming to a portion of a combination of two cylindrical surfaces (29,30) joined to each other along a straight joining line ($m_{s1}$–$m_{sn}$) in an algebraically and geometrically continuous manner, said portion being formed of elements constituted by mutual intersection lines between said cylindrical surfaces (29,30) and successive coaxial conical surfaces ($\mathbf{15}_{11}$ $\mathbf{15}_{21}$ . . . $\mathbf{15}_{n1}$) varying between said conical surfaces of said main and side plates, said coaxial conical surfaces progressively diminishing in cone angle from said main plate to said side plate and having a common axis (H) coinciding with said axis (14) of rotation of the shaft, said straight joining line ($m_{s1-msn}$) and the common axis (H) lying in a common plane (V,W) and forming an angle (K) therebetween.

2. A fan wheel as set forth in claim 1 wherein said cylindrical surfaces (19,20) are tangent to each other along said straight joining line ($m_{s1}$–$m_{sn}$), and so disposed relative to said axis (14) of rotation of the shaft that each blade (11), as viewed in a section taken along a representative streamline from the entrance part to the exit part, has a curved portion, near the entrance part thereof, corresponding to one of said cylindrical surfaces and a reversely curved portion, near the exit part thereof, corresponding to the other of said planar surfaces.

* * * * *